United States Patent [19]

Kappenhagen

[11] Patent Number: 4,685,537

[45] Date of Patent: Aug. 11, 1987

[54] ELEVATOR SYSTEM WHICH UTILIZES BOTH RIGID AND RESILIENT MOUNTING ARRANGMENTS FOR DOOR OPERATOR

[75] Inventor: George A. Kappenhagen, Stroud Township, Monroe County, Pa.

[73] Assignee: Westinghouse Electric Corp., Pittsburgh, Pa.

[21] Appl. No.: 892,975

[22] Filed: Aug. 4, 1986

[51] Int. Cl.[4] ..... B66B 13/00

[52] U.S. Cl. ..... 187/103; 187/52 R

[58] Field of Search ..... 187/51, 52 R, 56, 103

[56] References Cited

U.S. PATENT DOCUMENTS

| | | | |
|---|---|---|---|
| 2,867,292 | 1/1959 | Bruns | 187/103 |
| 3,462,883 | 8/1969 | Reeks et al. | 187/103 |
| 4,004,655 | 1/1977 | Kraft et al. | 187/52 R |
| 4,043,430 | 8/1977 | Kraft et al. | 187/52 R |
| 4,149,615 | 4/1979 | Kappenhagen | 187/52 R |

*Primary Examiner*—William M. Shoop, Jr.
*Assistant Examiner*—W. E. Duncanson, Jr.
*Attorney, Agent, or Firm*—D. R. Lackey

[57] ABSTRACT

An elevator system including an elevator car, a door for closing and opening an entrance into the elevator car, and a door operator on the canopy or car top which is operatively linked to the door. The door operator casing or enclosure is made into a practical enclosure for several shock sensitive functions, including the car controller and the landing and terminal zone switches, by rigidly mounting the door operator enclosure to the canopy, and by resiliently mounting the door operator drive assembly within the enclosure.

8 Claims, 4 Drawing Figures

ELEVATOR SYSTEM WHICH UTILIZES BOTH RIGID AND RESILIENT MOUNTING ARRANGMENTS FOR DOOR OPERATOR

BACKGROUND OF THE INVENTION

1. Field of the Invention

The invention relates in general to elevator systems, and more specifically to arrangements for reducing the number of enclosures and inter-enclosure wiring in an elevator system.

2. Description of the Prior Art

U.S. Pat. Nos. 4,004,655 and 4,043,430, which are assigned to the same assignee as the present application, disclose utilizing the enclosure which encases the door operator mechanism as a common enclosure for other related functions. Thus, the door operator enclosure functions as a wiring trough or duct which permits open wiring between the door operator drive motor, door speed and door limit switches, door speed control resistors, radiant energy object detector control, emergency lighting power pack, and alarm bell.

An elevator system includes many other functions which are separately housed in dedicated enclosures, which must be field mounted and interconnected according to the National Electrical Code and applicable elevator codes. Thus, it would be desirable to extend the idea set forth in the hereinbefore mentioned patents, to permit factory assembly and wiring of substantially all of the controls associated with an elevator car. This has not been done in the prior art because the typical door operator drive assembly creates heat, vibration and shock forces during its operation, and most separately mounted elevator car related functions include switches, relays and solid state controls which are either shock sensitive, heat sensitive, or both.

SUMMARY OF THE INVENTION

Briefly, the present invention is a new and improved elevator system in which the enclosure for the door operator utilizes both rigid and resilient mounting techniques to make it practical for the door operator enclosure to also function as a mounting panel and enclosure for shock sensitive control functions, such as landing and zone switches, and even the car controller which is normally mounted in the machine room. This permits a factory assembly and open wiring between these components, substantially reducing field assembly time and associated costs. It also reduces the number of conductors required in the traveling cable, as the wiring between the car station and the car controller is retained on the car. The present invention also simplifies the wiring between the car station and the car controller by utilizing the swing return in the elevator car as a wiring duct which extends to the canopy, and by enclosing the space between the bottom of the door operator enclosure and the top of the canopy to continue the wiring duct defined by the swing return to the door operator enclosure.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
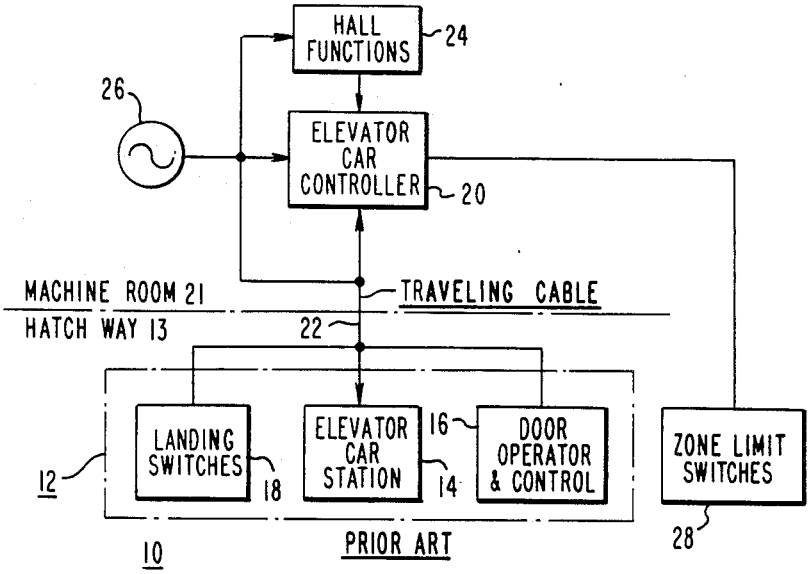
FIG. 1 is a block diagram illustrating how a typical elevator system of the prior art is arranged in separate enclosures and interconnected.

Referring now to the drawings, and to FIG. 1 in particular, there is shown a single car elevator system 10 illustrating a typical arrangement of its functional parts. For example, in a single car elevator system, an elevator car 12 is disposed in a hatchway 13 of an associated building. Elevator car 12 includes a car station 14, a door operator 16 and its associated control, and landing switches 18. The car station 14 is mounted inside the elevator car 12, the door operator 16 is mounted on top of the car 12 in a dedicated enclosure, and the landing switches are mounted on top of the car 12, also in a separate enclosure.

A car controller 20 is located remotely from the car, such as in a machine room 21 where the motive means for the elevator car is located, with communication between the elevator car 12 and the car controller 20 being accomplished via a traveling cable 22. The hall functions, shown generally at 24, communicate directly with the car controller 20. A source 26 of electrical potential is connected to the car controller 20, to the hall functions 24, and to the elevator car 12, with the connection to the car 12 being via the traveling cable 22. Zone limit switches 28, which may be of any suitable type, such as magnetic or optical, and which respond to actuators carried by the elevator car 12, are mounted in the hatchway 13 so they can be directly wired to the car controller 20.

Figure 2:
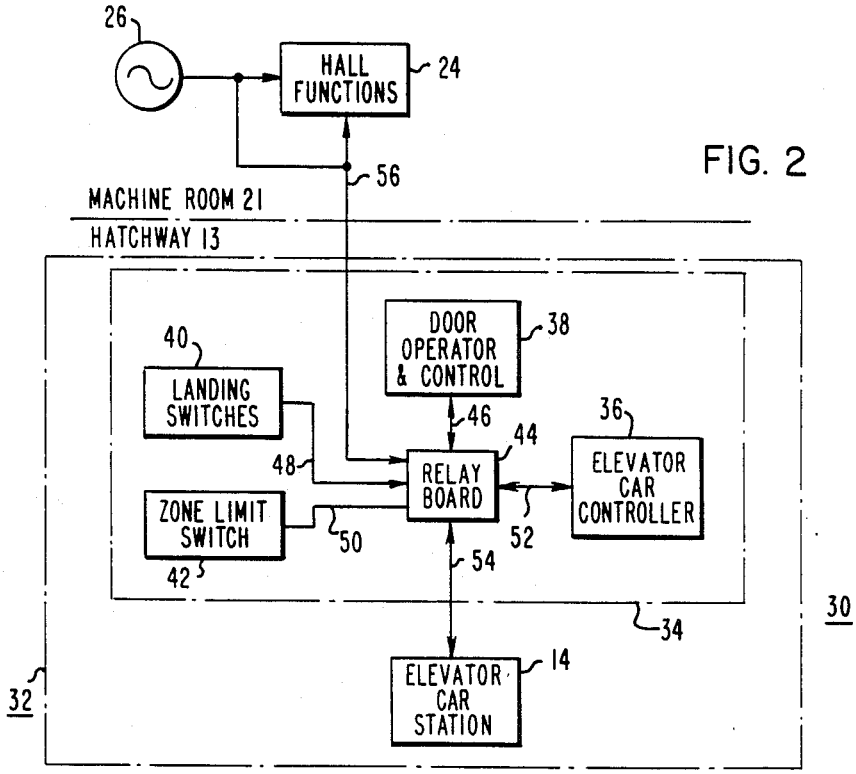
FIG. 2 is a block diagram illustrating an elevator system arranged and interconnected according to the teachings of the invention.

FIG. 2 is a block diagram of a single car elevator system 30 having an elevator car 32, with the functions of elevator system 30 being arranged according to the teachings of the invention. Functions which are the same as those in FIG. 1 are given the same reference numerals in FIG. 2. Broken outline 34 represents a single enclosure mounted on top of elevator car 32. Functions mounted within the enclosure 34 include a car controller 36, a door operator 38, landing switches 40, and a zone limit switch 42 function. Only one zone limit switch 42 is required if the required number of contacts can be accommodated, and it will thus be referred to as singular. In practice, the required number of contacts are provided by stacking two switches. A single relay board 44 is also mounted within enclosure 34, with the relays associated with all the functions disposed in enclosure 34 being grouped on the common relay board 44. Wiring 46, 48, 50 and 52 between the functions disposed within the single enclosure 34 may be open, as the enclosure 34 functions as a large junction box. Communication between the elevator car station 14 and the relay board 44 may be direct via wires shown generally at 54, i.e., the wires 54 will not be in a traveling cable 56. The hall functions 24 and the relay board 44 communicate with one another via the traveling cable 56. The source 26 of potential will also be connected to the car functions via wires in the traveling cable 56.

Figure 3:
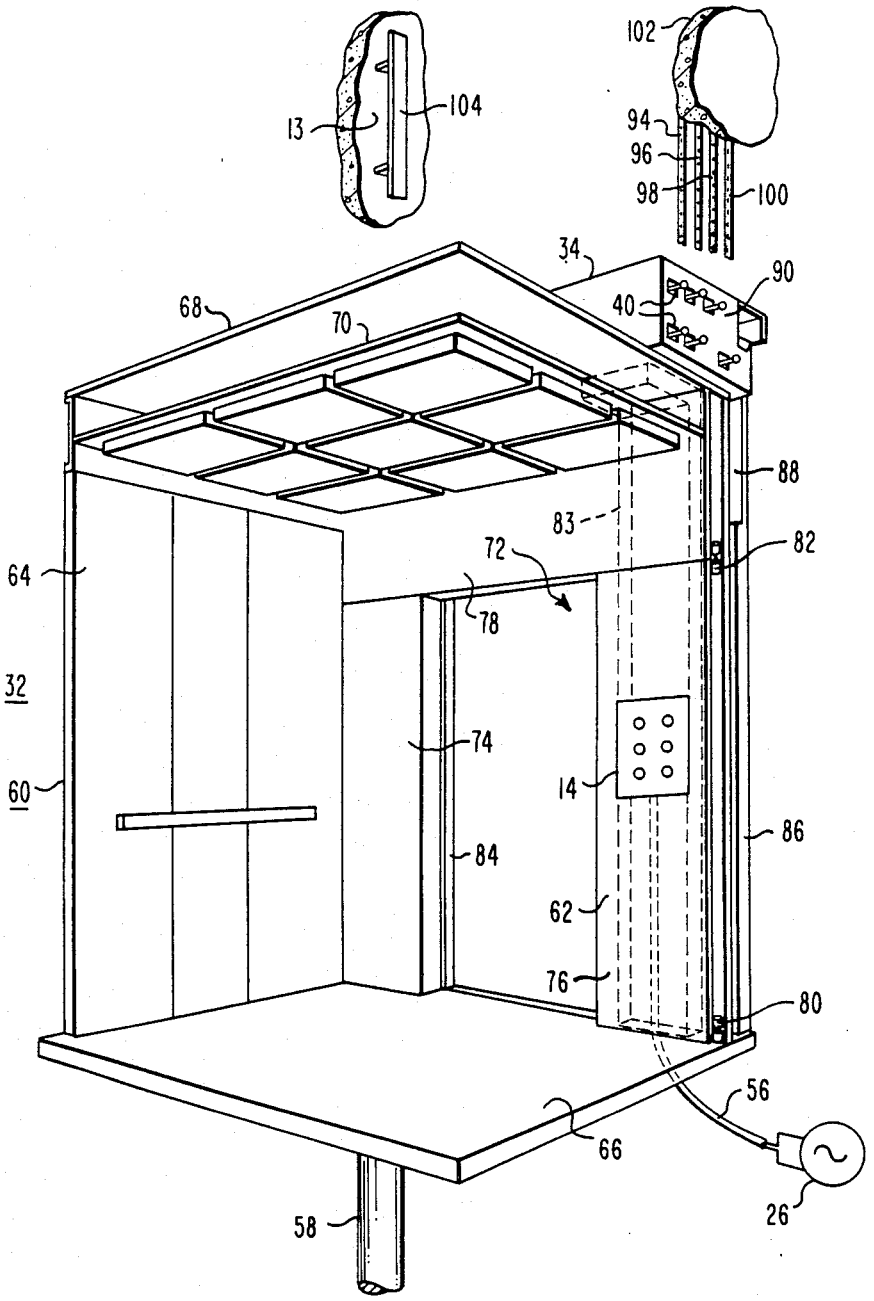
FIG. 3 is a perspective view of an elevator car with the back and one sidewall removed, constructed according to the teachings of the invention.

FIG. 3 is a perspective view of elevator car 32 shown in block, functional form in FIG. 2, with the back and one side of the car 32 being cut away in order to more clearly illustrate the inside of car 32. Elevator car 32, which may be supported in hatchway 13 via the ram 58 of a hydraulic cylinder, or by hoist roping, as desired, includes a cab 60 having a front portion 62, a side portion 64, and the back and side portions which are cut away in the view of FIG. 3. The front, side and back portions are assembled on a platform 66. A top or canopy 68 extends between the upper edges of the upstanding wall portions of the cab 60, and a drop ceiling 70 may be suspended from the canopy 68. The front portion 62 defines an opening 72 into the cab 60, which may be centered, as illustrated, or it may be disposed adjacent to one side or the other, as desired. In the center opening type, the front portion 62 includes two returns 74 and 76. A transom 78 may be disposed above the opening 72.

The car station 14 is mounted on the front portion 62, in one of the returns, such as return 76. Return 76 may be a swing return, as indicated by pivots 80 and 82. Return 76 has spaced internal and external walls which define a vertically extending wiring duct 83 which extends to the canopy 68. The internal wall is the wall in which the car station 14 is mounted, and the external wall is the wall 85 visible from outside the car 32 in FIG. 4. The traveling cable 56 extends from the midpoint of the hatchway 13 to the platform 66, and then to a terminal block in the car station 14, utilizing the duct 83 defined by the swing return.

Doors are mounted to open and close access to the car 32 via opening 72, such as door panels 84 and 86, which are shown in their open positions.

The single, common enclosure 34 is mounted on top of the canopy 68. Enclosure 34 is an elongated structure, dimensioned to overhang the canopy 68 on both sides of the canopy and in the front of the canopy. The overhang of enclosure 34 on the front of the canopy enables door hangers, such as door hanger 88, to link the door panels and the door operator function located in enclosure 34. The overhangs of the enclosure 34 on the sides of the canopy 68 permit the sides of enclosure 34 to function as panels for the landing switches 40 and the zone switch 42. For example, side 90 supports the landing switches 40, and side 92, shown in FIG. 4, supports the zone switch 42. The landing switches 40 are actuated by cams located on metallic tapes 94, 96, 98 and 100 which are connected to the building structure 102 which defines the hoistway 13. The zone switch 42 is actuated by a magnetic vane or element 104, which is also mounted in the hatchway 13.

Figure 4:
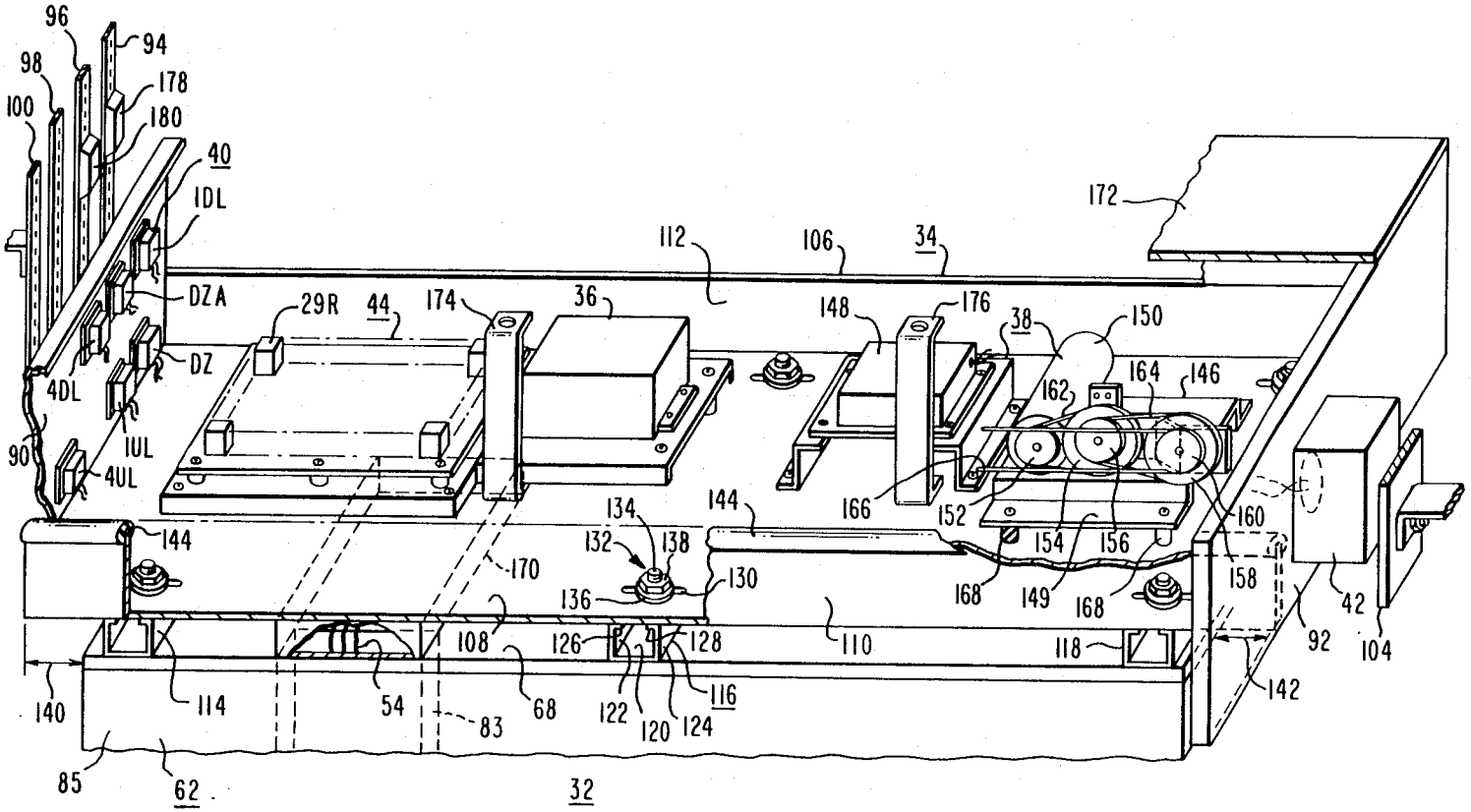
FIG. 4 is a perspective view of a door operator assembly constructed according to the teachings of the invention, with the cover removed in order to illustrate the arrangement and construction of the different functions.

FIG. 4 is a perspective view of enclosure 34, with the cover or top of the enclosure being cut away, in order to illustrate the construction and mounting arrangement of the functions within the enclosure 34, which make the consolidation of the hereinbefore mentioned functions practical.

More specifically, enclosure 34 includes a metallic, channel shaped base frame member 106 having a bight 108 and first and second upstanding legs 110 and 112, respectively. Unlike the door operator enclosure of the hereinbefore mentioned United States patents, which enclosure is mounted to the top of the elevator cab via vibration and sound isolation fasteners, the base frame member 106 is rigidly mounted to the canopy 68. In a preferred embodiment of the invention, base frame member 106 is mounted to canopy 68 via a plurality of spaced metallic channel members 114, 116, and 118. Each channel member, such as channel member 116, includes a bight 120 which is fastened to the canopy 68, and two spaced upstanding leg portions 122 and 124. Leg portions 122 and 124 terminate with flanges 126 and 128 which are spaced to define an elongated slot or opening to the interior of the channel configuration. Fasteners for the base frame member 106 extend upwardly from the channel members through elongated slots in the bight 108 of the base frame member 106. The elongated slots, such as slot 130, are elongated in a direction which allows the base frame member 106 to be positionally adjusted in a direction between the two sides of the elevator car 32. The channel members such as channel member 116, allow the fasteners, such as fastener 132, to slide in the associated channel before the fastener is tightened, to provide positional adjustability of the base frame member 106 in a direction between the front and back of the elevator car 32. The fasteners, such as fastener 132 may include a bolt 134, a washer 136 and a nut 138, for example. Thus, base frame member 106 is initially positioned on the canopy 68 with fasteners 132 partially tightened, which allows the base frame member to be tapped to the correct position and then the fasteners 132 are tightened. The correct position includes providing the correct dimensional overhangs of the enclosure 34 past the sides of the canopy 68, indicated by double headed arrows 140 and 142, as well as the correct overhang of enclosure 34 past the front edge of the canopy 68. The upper edge of the first upstanding leg portion 110 of the base frame member 106 includes a non-metallic tight fitting member 144, such as a Nylon extrusion, to function as a door hanger roller track.

The door operator apparatus 38 includes a drive assembly 146 and door control 148. The drive assembly 146 includes a base or frame 149 upon which a drive motor 150 and a belt reduction drive arrangement are mounted. The belt reduction includes pulleys 152, 154, 156, 158 and 160, belts 162 and 164, and a cable and belt arrangement 166 to which the door hanger plates 88 are attached. It is important to note that the base or mounting frame 149 is resiliently mounted to the bight 108 of base frame 106 via a plurality of vibration and sound isolating members 168. Mounting frame 149 may also be resiliently mounted to end 92, if greater stability is required. The forces and shocks involved in rapidly accelerating, decelerating, and stopping the door panels 84 and 86 are thus absorbed by the isolating shock mounts 168, and not by the enclosure 34. As hereinbefore stated, the enclosure 34 is rigidly mounted to the canopy 68, and thus to the elevator cab 60. This door operator arrangement, which includes both rigid and resilient mounting arrangements, enables the door operator enclosure 34 to be utilized for housing functions which it would otherwise be unable to house and support because of the vibration and shock forces associated with prior art door operator mounting arrangements.

The door control 148 is preferably of the solid state pulse control type, which eliminates the need for resistors associated with speed control. The elimination of the speed control resistors reduces the amount of heat which must be dissipated from enclosure 34, enabling heat sensitive solid state control devices to be placed in enclosure 34 without the need for auxiliary cooling means, such as a fan. Certain of the door control functions which are required to be performed by relay, such as the hatch door interlock relay, are located on the relay board 44. Other door operator functions, such as the door speed control and limit switches, and door position switches, are not shown in order to simplify the drawing. Since these related door operator functions are illustrated in the hereinbefore mentioned U.S. Pat. Nos. 4,004,655 and 4,043,430, these patents are hereby incorporated into the present specification by reference.

The car controller 36, which is normally mounted remotely from the elevator car 32, is mounted within enclosure 34, since enclosure 34 is not vibrated and shocked by door operation, and since very little heat generating elements are mounted within enclosure 34. The wiring duct 83 defined by the swing return 76 extends from the car station 14 to the canopy 68. The canopy 68 is notched and a wiring trough or duct 170 continues the duct 83 under the bight 108 of the base frame 106, in the space provided by the support channels 114, 116 and 118. Wiring duct 170 extends from duct 83 to the relay board 44. Thus, the wiring 54 between the relay board 44 and the car station 14 is completely enclosed in a metallic duct which for the most part utilizes metallic elements which are already required in the disclosed construction, i.e., the swing return, and the natural spacing between the bottom of the enclosure 34 and the top of the canopy 68.

The relays associated with the car station 14 are mounted on the relay board 44, such as the car call and call reset relays. The relay board 44 also includes relays associated with the control of the elevator car 32, such as the safety relay 29R, the anti-stall relay associated with hydraulic elevator cars, the travel direction relays, parking floor relay, speed and acceleration control relays, and the like. Also, since the hall functions 24 are connected to the elevator car via the traveling cable 56, the floor relays may also be mounted on relay board 44.

Enclosure 34 is completed by upstanding panels 90 and 92 which enclose the ends of the base frame channel member 106, and a cover 172, which for the most part is shown cut away. Cover support brackets 174 and 176 provide intermediate support for the cover 172.

Upstanding end panel 90 functions as a switch support wall for the landing switches 40 which are normally mounted in a separate enclosure. The invention enables the landing switches 40 to be mounted on the door operator enclosure 34 because of the unique mounting arrangement of the enclosure, hereinbefore referred to, and because the anti-creep switches 1DL and 1UL and operated by two cams in two separate cam lanes 94 and 96, such as by cams 178 and 180 on cam lanes or tapes 94 and 96, respectively. Splitting the anti-creep function into two lanes enables this function to be performed within the height of the side panel 90. It also has the advantage of enabling the up and down direction anti-creep functions to be independently adjusted, which is difficult to do with one anti-creep lane and one anti-creep cam per floor. The slowdown relays 4DL and 4UL, and door zone relays DZ and DZA are also mounted on end panel 90.

In the prior art, it is desirable for the hatch zone switches to be directly wired to the car controller without going through the traveling cable, and thus two switches are mounted in the hatch, one adjacent to each terminal floor. A magnetic vane carried by the car actuates the zone switches. Since the car controller 36 in the present invention is mounted on the elevator car, direct wiring without going through the traveling cable may be accomplished by mounting a single zone switch 42 on the car, which is responsive to two magnetic vanes mounted in the hatchway near the terminal floors, such as magnetic element 104 shown in FIG. 3. End panel 92, even when used as one of the resilient mounting anchors for the drive assembly 146, is not unduly vibrated because it is solidly fixed to base frame 106. Thus, end panel 92 may be used to support the zone switch 42, making it unnecessary to provide a separate mounting bracket, and separate enclosed wiring from the switch to the associated controls is also eliminated. Open wiring 50 is utilized from the zone limit switch 42 to the relay board 44.

In summary, there has been disclosed a new and improved single car elevator system in which the door operator enclosure is arranged to house completely independent elevator car related functions, such as the car controller, the landing switches, the zone switch, and the like. This eliminates the need for separate enclosures for these functions, and it enables open wiring to be used to interconnect the functions. This arrangement is made possible by a new and improved mounting arrangement for the door operator enclosure and its drive assembly component, which arrangement includes both rigid and resilient mounts.

We claim as our invention:

1. An elevator system, comprising:

a building having an elevator hatchway, an elevator car mounted for movement in said hatchway, said elevator car including a canopy, a door having at least one panel, and door operator means mounted on said canopy for operating said door, said door operator means including an enclosure, means rigidly fixing said enclosure to said canopy, a drive assembly, and means resiliently mounting said drive assembly within said enclosure.

2. The elevator system of claim 1 including a car controller mounted within the enclosure of said door operator means.

3. The elevator system of claim 2 including a swing return in the elevator car which defines an electrical wiring duct which terminates with an open end adjacent to the canopy, and means which encloses the open end of the wiring duct and effectively extends the wiring duct across the canopy to an opening in the enclosure of the door operator means, and a car station mounted on said swing return having electrical wiring disposed to extend from the car station to the car controller via said wiring duct.

4. The elevator system of claim 1 including switch actuating means fixed in the hatchway, and electrical switch means fixed to the enclosure of the door operator means for cooperating with said switch actuating means in the hatchway.

5. The elevator system of claim 4 wherein the switch actuating means includes first and second anti-creep lanes, and the electrical switch means includes first and second switches oriented to be actuated by said first and second anti-creep lanes.

6. The elevator system of claim 4 wherein the door operator enclosure is an elongated structure having a first end which overhangs the canopy, with said electrical switch means being fixed to said overhanging first end.

7. The elevator system of claim 4 wherein the door operator enclosure is an elongated structure having first and second ends which overhang the canopy, with said electrical switch means including switches fixed to both said overhanging first and second ends.

8. The elevator system of claim 1 including a car controller, landing switch means, and relays associated with: (a) the door operator means, (b) the car controller and (c) the landing switch means; and wherein the car controller, the landing switch means and the relays all disposed within the door operator casing; and including a common relay board in the door operator casing, with said relays being mounted on said common relay board.

* * * * *